US006658758B2

(12) United States Patent
Kahl et al.

(10) Patent No.: US 6,658,758 B2
(45) Date of Patent: Dec. 9, 2003

(54) DRYING SECTION WITH IMPINGEMENT DRYING UNIT

(75) Inventors: Peter Kahl, Gerstetten (DE); Markus Oechsle, Bartholomae (DE); Wolfgang Mayer, Heidenheim (DE); Georg Kugler, Heidenheim (DE); Roland Mayer, Heidenheim (DE)

(73) Assignee: Voith Paper Patent GmbH, Heidenheim (DE)

( * ) Notice: Subject to any disclaimer, the term of this patent is extended or adjusted under 35 U.S.C. 154(b) by 0 days.

(21) Appl. No.: 09/852,021

(22) Filed: May 10, 2001

(65) Prior Publication Data

US 2001/0045023 A1 Nov. 29, 2001

(30) Foreign Application Priority Data

May 24, 2000 (DE) ..... 100 25 560
Oct. 19, 2000 (DE) ..... 200 17 924

(51) Int. Cl.[7] ..... F26B 11/02
(52) U.S. Cl. ..... 34/117; 34/123; 34/611
(58) Field of Search ..... 34/391–395, 413, 34/414, 419–422, 428, 443–466, 581, 108–111, 113–120, 122–124, 611

(56) References Cited

U.S. PATENT DOCUMENTS 3,633,282 A * 1/1972 Candor et al. ..... 34/250
4,096,643 A * 6/1978 Futcher ..... 34/114
4,429,998 A * 2/1984 Carson et al. ..... 250/559.46
4,483,745 A * 11/1984 Wicks et al. ..... 162/205
4,493,994 A * 1/1985 Hilton ..... 209/534
4,523,522 A * 6/1985 Fischer ..... 101/219
4,709,872 A * 12/1987 Hammer et al. ..... 242/421.6
4,768,294 A * 9/1988 Weideburg ..... 34/116
4,943,351 A * 7/1990 Wedel ..... 162/202
5,036,765 A * 8/1991 Keilhau ..... 101/219
5,188,028 A * 2/1993 Reichel ..... 101/228
5,308,450 A * 5/1994 Braun et al. ..... 162/358.3
5,383,288 A 1/1995 Ilmarinen
5,431,787 A * 7/1995 Braun et al. ..... 162/358.3
5,520,782 A * 5/1996 Schiel ..... 162/205
5,540,817 A * 7/1996 Schiel ..... 162/203
5,582,359 A * 12/1996 Wicha ..... 101/227
5,705,034 A * 1/1998 Schiel ..... 162/205
5,845,415 A * 12/1998 Sundqvist ..... 34/452
5,865,955 A * 2/1999 Ilvespaa et al. ..... 162/206
5,888,354 A * 3/1999 Laapotti ..... 162/306
5,933,981 A * 8/1999 Meschenmoser ..... 34/114
5,951,821 A * 9/1999 Laapotti ..... 162/205
5,968,590 A * 10/1999 Ahonen et al. ..... 34/117
6,003,241 A * 12/1999 Komulainen et al. ..... 34/117
6,003,245 A * 12/1999 Lipponen et al. ..... 34/117
6,004,430 A 12/1999 Ilvespää et al.

(List continued on next page.)

FOREIGN PATENT DOCUMENTS

| | | |
|---|---|---|
| DE | 19841768 | 3/2000 |
| DE | 19935138 | 5/2000 |
| EP | 559628 | 9/1993 |
| WO | 99/64671 | 12/1999 |
| WO | 00/00693 | 1/2000 |
| WO | 00/08252 | 2/2000 |

*Primary Examiner*—Ira S. Lazarus
*Assistant Examiner*—Andrea M. Ragonese
(74) *Attorney, Agent, or Firm*—Greenblum & Bernstein, P.L.C.

(57) ABSTRACT

In a drying section of a machine for producing a material web such as, in particular, a paper or cardboard web, a pick-up suction roll, in particular a larger pick-up suction roll, is provided between the last pressing nip of a pressing section and a subsequent impingement drying unit, which suction roll removes the material web from a pressing felt guided through the pressing nip or from a transfer belt and transfers it to the impingement drying unit.

49 Claims, 4 Drawing Sheets

U.S. PATENT DOCUMENTS 6,098,309 A * 8/2000 Halmschlager et al. ..... 34/273
6,101,735 A * 8/2000 Kuhasalo et al. ..... 162/207
6,197,159 B1 * 3/2001 Meinecke et al. ..... 162/205
6,235,158 B1 * 5/2001 Dahl et al. ..... 162/203
6,254,726 B1 * 7/2001 Steiner et al. ..... 162/198
6,287,426 B1 * 9/2001 Edwards et al. ..... 162/280
6,294,050 B1 9/2001 Oechsle et al.
6,336,996 B1 * 1/2002 Steiner ..... 162/193
6,365,004 B1 * 4/2002 Hamstrom et al. ..... 162/198
6,367,164 B1 * 4/2002 Oechsle et al. ..... 34/117
6,372,090 B1 * 4/2002 Laapotti ..... 118/67
6,442,865 B1 * 9/2002 Wolf et al. ..... 34/114
2001/0020524 A1 * 9/2001 Kotitschke et al. ..... 162/396
2002/0060042 A1 * 5/2002 Klerelid et al. ..... 162/358.1

* cited by examiner

DRYING SECTION WITH IMPINGEMENT DRYING UNIT

CROSS-REFERENCE TO RELATED APPLICATIONS

The present application claims priority under 35 U.S.C. §119 of German Patent Application No. 100 25 560.4 filed May 24, 2000 and of German Patent Application No. 200 17 924.1 filed Oct. 19, 2000, the disclosures of which are expressly incorporated by reference herein in their entireties.

BACKGROUND OF THE INVENTION

1. Field of the Invention

The invention relates to a drying section of a machine for producing a material web, e.g., a paper or cardboard web.

2. Discussion of Background Information

In the multi-cylinder drying sections that have been common up to now, the paper web is guided over several steam-heated cylinders or over an arrangement of several steam-heated cylinders and wire suction rolls for the purpose of drying it. Especially at the beginning of the drying process, when the moist paper does not yet have sufficient strength, problems often occur with regard to the web guidance, which can be attributed, in particular, to the fact that the still-moist web sticks to the smooth surfaces, which are absolutely necessary for sufficient heat conduction. In order to be able to remove the web from the cylinders, a sufficient web tension is necessary, which can only be produced by pulling, i.e., a differential speed, before or directly after the first smooth contact surface. This often causes tears and an overstretching of the edges and the speed of the paper machine is limited correspondingly because the above-mentioned problems occur more intensely at higher speeds and the tension must be increased.

One possible solution is to provide a large cylinder or a large suction roll with an associated impingement hood between the pressing section and the multi-cylinder drying section (see, e.g., DE 19 841 768 and DE 19 935 138). However, this usually produces one or more longer transfer paths that are straight or only slightly curved between the last pressing nip and the large roll or cylinder for the purpose of creating a certain distance between the last press and the large roll or cylinder; in these transfer paths, the web must be held, e.g., on a wire or felt by transfer foils. Because of the relatively straight web guidance that results, web travel problems occur, such as, in particular, lifting or turning down of the edges or transfer difficulties.

SUMMARY OF THE INVENTION

The present invention provides a drying section of the type mentioned at the outset which, at the same time, essentially guarantees at high speeds as optimal a drying rate as possible at the beginning of drying as well as a secure web guidance. Further, a reliable transfer should especially be ensured.

According to the invention, a pick-up suction roll, in particular a larger one, is provided between the last pressing nip of a pressing section and a subsequent impingement or jet impingement drying unit. The roll removes the material web from a press felt guided through the last pressing nip or from a transfer belt and transfers it to the impingement drying unit.

Because of this construction, the above-mentioned web travel paths, which are rather long and straight or only slightly curved, are prevented. In this manner, a reliable transfer and a secure web travel is achieved on the edges as well. Due to the web guidance now being curved, the danger of lifting or turning down of the edges is removed and the transfer of the web is facilitated.

The outer diameter of the pick-up suction roll preferably lies in the range of approximately 1.2 to approximately 2.5 m.

In an exemplary embodiment of the drying section according to the invention, the pick-up suction roll is wrapped by a wire. The wire in question is correspondingly tensed. Here, in particular, a wire travel regulator can be provided as well. The wire tension can also be regulated correspondingly.

Instead of a wire, it is also conceivable for the pick-up roll to be provided with an appropriate surface. Thus, this pick-up suction roll can, e.g., be coated with a screen stocking.

The pick-up suction roll can be provided with a suction box located in its interior or can be provided with suction by way of its jacket from an outside suction box. For this purpose, the jacket can be provided, e.g., with indentations such as grooves or the like.

It is advantageous to provide the pick-up suction roll with a multi-zone suction box in order to set various levels of vacuum in the crosswise direction and/or in the machine direction and/or to be able to utilize various suction box angles.

The impingement drying unit advantageously includes a support roll, e.g., a larger support roll, or the like with an impingement dryer assigned thereto, with the material web being transferred onto the support roll by the pick-up suction roll.

It is also possible to provide one or even several, preferably two or three, such impingement drying units, preferably including a support roll, e.g., a larger support roll, and an impingement dryer assigned thereto.

It is useful for the outer diameter of a given support roll to lie in the range of approximately 2.5 to approximately 8 m and preferably in the range of approximately 3 to approximately 5 m.

The outer diameter of the enlarged pick-up suction roll is preferably smaller than the one given support roll.

In a preferred embodiment of the drying section according to the invention, the support roll is wrapped by a wire. Correspondingly, the material web is transferred from the pick-up suction roll to this wire wrapping the support roll of the impingement drying unit.

The support roll of a given impingement drying unit can be formed, e.g., by a suction roll or a cylinder. However, instead of the support roll, a support belt guided over several support rolls can be provided. In this case, it is useful for the support rolls to be at least partially arranged on the arc of a circle.

Preferably, at least one impingement drying unit with an impingement hood is provided.

Preferably, the web is blown on directly from such an impingement hood. Several impingement units directly following one another, preferably two or three such units, can be provided before the first cylinder group in the web travel direction. The material web can be dried, e.g., up to a dry content in the range of approximately 55 to approximately 65% before it is guided to the first cylinder group. Thus, the dry content achieved before the first cylinder group must be higher the lower the basis weight, the higher the ash content, and the higher the machine speed.

In an advantageous embodiment of the drying section according to the invention, the impingement hood is positioned in the impingement drying unit provided subsequently to the last pressing nip or the wrapping angle covered by the impingement hood is selected in such a way that a minimal distance between the associated larger support roll and the last pressing nip is made possible. The impingement drying unit provided subsequently to the last pressing nip preferably includes a one-piece impingement hood while any other drying unit that may be provided after it is usefully provided with a two-part hood.

If at least two impingement drying units following one another are provided, the material web is preferably transferred from the wire of the one, preceding unit immediately to the large support roll of the subsequent other unit. Thus, the straight section of the web travel between the two units in question is kept as short as possible.

Impingement drying units following one another can be arranged in an alternating fashion in such a way that different sides of the web can be impinged by the impingement drying units in question. It is advantageous for the impingement drying unit provided subsequently to the last pressing nip to impinge the upper side and for the subsequent impingement drying unit to impinge the lower side of the material web. In principle, however, it is also possible to impinge first the lower side and then the upper side of the material web.

Thus, the pick-up suction roll, in particular the larger pick-up suction roll, according to the invention can thus be used, in particular, together with one or more subsequent impingement or jet impingement dryers on a respective larger support roll, e.g., a suction roll or a cylinder, and, in particular, used after a pressing section in which all the nips are double-felted or double-covered, i.e., each provided with either two felts or one felt and one transfer belt. The enlarged pick-up suction roll according to the invention can particularly be used in a fast-moving paper machine, i.e., at machine speeds greater than, for example, approximately 1400 m/min and preferably greater than 1500 m/min for low base weights (for example, newsprint, SC, LWC).

Further advantageous embodiments of the drying section according to the invention are presented in the pending claims that can also be advantageously used considered by themselves and, correspondingly, can particularly also be seen as alternative independent embodiment variations of the drying section according to the invention.

Thus, one variation of the preferred embodiment of the drying section according to the invention includes at least one impingement drying unit provided between the last pressing nip of a pressing section and a first multi-cylinder group and the impingement drying unit provided subsequently to the last pressing nip is provided with a one-piece impingement hood while a multi-part, e.g., two-part, impingement hood is assigned to at least one further impingement drying unit.

A one-part impingement hood on a large suction roll between the last press nip and the first multi-cylinder group is conceivable without transfer with an enlarged pick-up roll, possibly followed by other impingement hoods, which would then be two-part.

According to a further variation, the drying section can include at least one impingement drying unit provided between the last pressing nip of a pressing section and a first multi-cylinder group for the purpose of increasing the dry content of the material web to a value in the range of approximately 55 to approximately 65%. Thus, the necessary tension in and after the presses is reduced, which allows higher speeds and/or a conservation of fibers without a loss of runnability and which leads to a less strongly pronounced shrinkage cross profile, which is conditional upon, among other things, the fact that a lower fiber orientation in the sheet (stream-wire difference, long lamellas) can be conducted. The crosswise shrinkage and moist stretching in the printing machine are closely dependent on one another. An equalized shrinkage cross profile leads to improved paper behavior in the printing process, e.g., fewer register and travel problems in roll offset printing.

According to a further embodiment variant according to the invention, the drying section includes at least one impingement drying unit, preferably arranged between the last pressing nip of a pressing section and a first multi-cylinder group, with a connected or integrated IR unit. Such an IR (infrared) unit particularly serves to heat the material web.

According to a further embodiment variant, the drying section according to the invention includes at least one impingement drying unit that can be operated at a machine speed in the range of approximately 70 to approximately 120 m/s, preferably in the range of approximately 80 to approximately 100 m/s, and/or at a temperature of approximately 250 to approximately 450° C., preferably in the range of approximately 250 to approximately 350° C.

According to a further embodiment, the drying section according to the invention includes at least one impingement drying unit whose hood is provided with hole-type nozzles and/or suction slots that are preferably covered with diaphragms to protect them from scraps, i.e., paper scraps in particular. Here, the hole-type nozzles can have a diameter, e.g., in the range of approximately 6 to approximately 10 mm. These suction slots, which are covered by diaphragms, have an open nozzle surface, e.g., in the range of preferably approximately 1.5 to approximately 3.5%.

A further embodiment of the drying section according to the invention includes at least one impingement drying unit and a respective tear sensor provided before and/or after a respective impingement drying unit or between impingement drying units following one another. Partial tears must be detected as well, so it is useful for the monitoring to occur not only over one edge, but rather across the width. Here, for example, an optical sensor can be provided. Preferably, a vacuum measurement occurs in the suction rolls and/or in the pick-up roll.

The present invention is directed to a drying section of a machine for producing a material web located downstream, relative to a web travel direction, from a pressing section. The drying section includes an impingement drying unit and a pick-up suction roll positioned between a last pressing nip of the pressing section and the impingement drying unit. One of a pressing felt guided through the last pressing nip and a transfer belt is arranged to guide the material web. The pick-up suction roll is arranged to transfer the material web from the one of the pressing felt and the transfer belt to the impingement drying unit.

According to a feature of the instant invention, the pick-up suction roll can include a large suction roll. The material web may include one of a paper and cardboard web.

In accordance with another feature of the invention, an outer diameter of the pick-up suction roll may lie in the range of approximately 1.2 to approximately 2.5 m.

In accordance with a further feature of the invention, a wire may be arranged to wrap the pick-up suction roll.

According to still another feature, the pick-up suction roll can be coated with a screen stocking.

In accordance with still another feature, the pick-up suction roll can includes an interior suction box.

Further, the pick-up suction roll can include a jacket and an exterior suction box arranged to provide suction via the jacket.

According to another feature, the pick-up suction roll may include a multi-zone suction box.

Moreover, the impingement drying unit can include a support roll and an impingement dryer, and the support roll can be arranged to receive the material web from the pick-up suction roll. The support roll may be a larger support roll, and the support roll can have an outer diameter in the range of approximately 2.5 to approximately 8 m, and preferably, the outer diameter of the support roll may be in the range of approximately 3 to approximately 5 m. Further, a wire can be arranged to wrap the support roll, and the support roll may include a suction roll, and/or the support roll can include a cylinder.

The at least one impingement drying unit may include a support belt supported by several support rolls and an impingement dryer. The support rolls may be at least partially arranged on an arc of a circle.

Further, the at least one impingement drying unit can include at least two impingement dryer units, each including a support roll and an impingement dryer each support roll may be a larger support roll. Each support roll may have an outer diameter in the range of approximately 2.5 to approximately 8 m, and preferably an outer diameter of each support roll may be in the range of approximately 3 to approximately 5 m. At least two wires may be respectively arranged to wrap each support roll, and at least one of the support rolls may include a suction roll, and/or at least one of the support rolls can include a cylinder.

According to another feature of the invention, the at least one impingement drying unit may include at least two impingement drying units, in which each includes a support belt supported by several support rolls and an impingement dryer. The support rolls of each impingement drying unit may be at least partially arranged on an arc of a respective circle.

The at least one impingement drying unit can include at least one impingement hood. The at least one impingement drying unit can further include a support roll, and the at least one impingement dryer hood may be arranged to minimize a distance between the support roll and the last pressing nip. The at least one impingement drying hood can cover a wrapping angle ($\alpha$) of the support roll.

The at least one impingement drying unit may include at least two impingement drying units arranged to follow one another so that the material web is immediately transferred from a preceding impingement drying unit to a subsequent impingement drying unit. Each of the at least two impingement drying units may be wrapped by respective wires, such that the material web is transferred from the wire of the preceding impingement drying unit to the wire of the subsequent impingement drying unit.

The at least one impingement drying unit can include at least two impingement drying units arranged to follow one another in an alternating fashion. In this manner, different sides of the web are impinged by impingement streams. In a first impingement drying unit, arranged relative to the web travel direction, an upper side of the material web can be impinged and, in a subsequent impingement drying unit, a lower side of the material web can be impinged. Alternatively, in a first impingement drying unit, arranged relative to the web travel direction, a lower side of the material web can be impinged and, in a subsequent impingement drying unit, the upper side of the material web can be impinged.

In accordance with a still further feature of the invention, the drying section may be arranged between the last pressing nip of the pressing section and a first multi-cylinder group, and the at least one impingement drying unit can include a one-piece impingement hood. At least one further impingement drying unit can be provided, which may include a multi-part impingement hood. The multi-part impingement hood can include a two-part impingement hood.

The drying section may be arranged between the last pressing nip of the pressing section and a first multi-cylinder group in order to increase a dry content of the material web to within range of approximately 55% to approximately 65%.

Further, the at least one impingement drying unit may include a connected or integrated IR unit.

According to another feature of the invention, the at least one impingement drying unit may be operated at a machine speed within range of between approximately 70 to approximately 120 m/s, and preferably the machine speed range can be between approximately 80 to approximately 100 m/s. Further, the at least one impingement drying unit can be operated within a temperature range of between approximately 250 to approximately 450° C., and preferably the temperature range can be between approximately 250 to approximately 350° C.

The at least one impingement drying unit may include a hood having at least one of hole-type nozzles and suction slots. The at least one of hole-type nozzles and suction slits can be covered by diaphragms to protect them from scraps. The hole-type nozzles may have a diameter within a range of between approximately 6 to approximately 10 mm.

Further, the suction slots may be covered by diaphragms which are arranged to provide an open nozzle surface in a range of between approximately 1.5 to approximately 3.5%.

Moreover, at least one tear sensor can be positioned at least one of before and after the at least one impingement drying unit.

In accordance with yet another feature of the present invention, the at least one impingement drying unit can include at least two impingement drying units successively arranged in the web travel direction, and the drying section may further include at least one tear sensor positioned at least one of before, after, and between the two impingement drying units.

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Figure 1:
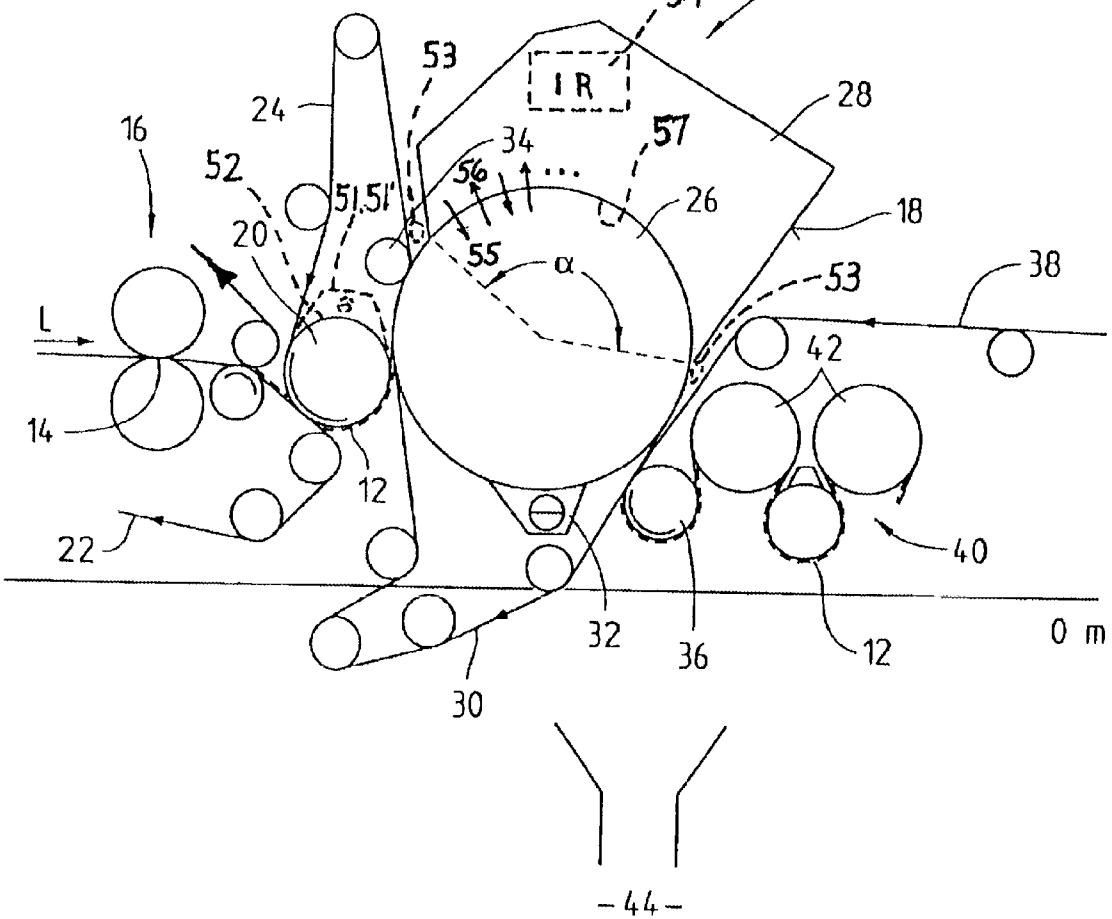
FIG. 1 schematically illustrates a first embodiment of a drying section with only one impingement drying unit.

FIG. 1 shows in a purely schematic depiction a drying section 10 of a machine for producing a material web 12, which can be a paper or cardboard web in particular.

Between a last pressing nip 14 of a pressing section 16 and a subsequent impingement or jet impingement drying unit 18, a larger pick-up suction roll 20 is provided that transfers material web 12 from a pressing felt 22 guided through last pressing nip 14 immediately to impingement drying unit 18.

The outer diameter of larger pick-up suction roll 20 can lie in a range of, e.g., approximately 1.2 to approximately 2.5 m.

Figure 1A:
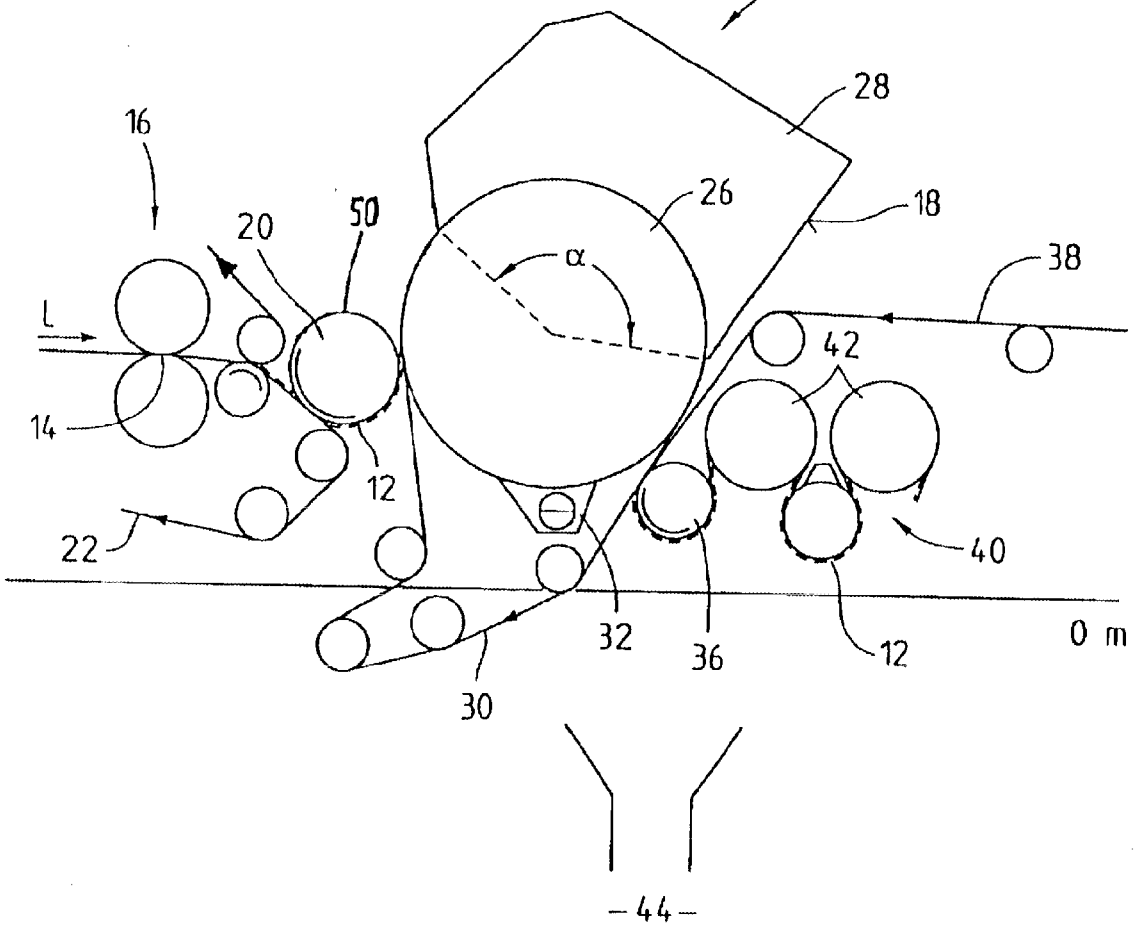
FIG. 1A illustrates an embodiment in which the suction roll is covered with a screen stocking.

In the present embodiment, pick-up suction roll 20 is wrapped by a wire 24. However, instead of wire 24, it is also conceivable for pick-up suction roll 20 to be provided with an appropriate surface, e.g., to be coated with a screen stocking 50 (as illustrated in FIG. 1A). Further, while pick-up suction roll 24 can be provided with a suction box located in its interior (as illustrated in FIG. 1), in an alternative, suction can be provided from an outside suction box 51 through indentations such as grooves in a roll jacket 52. In a further alternative, outside suction box 51 can be provided as a multi-zone suction box 51' in order to set various levels of vacuum in the crosswise direction and/or in the machine direction and/or to be able to utilize various suction box angles.

Impingement drying unit 18 includes a larger support roll 26 with an impingement or jet impingement dryer assigned thereto, which includes a one-piece impingement hood 28 in this case. Material web 12 is transferred by pick-up suction roll 20 to support roll 26 of impingement drying unit 18.

Support roll 26 can, in particular, have an outer diameter of, e.g., approximately 2.5 to 8 m, and preferably in the range of approximately 3 to approximately 5 m.

In the present embodiment, support roll 26 is surrounded by a wire 30 and formed by a suction roll to which an outer suction box 32 is assigned here.

Figure 2:
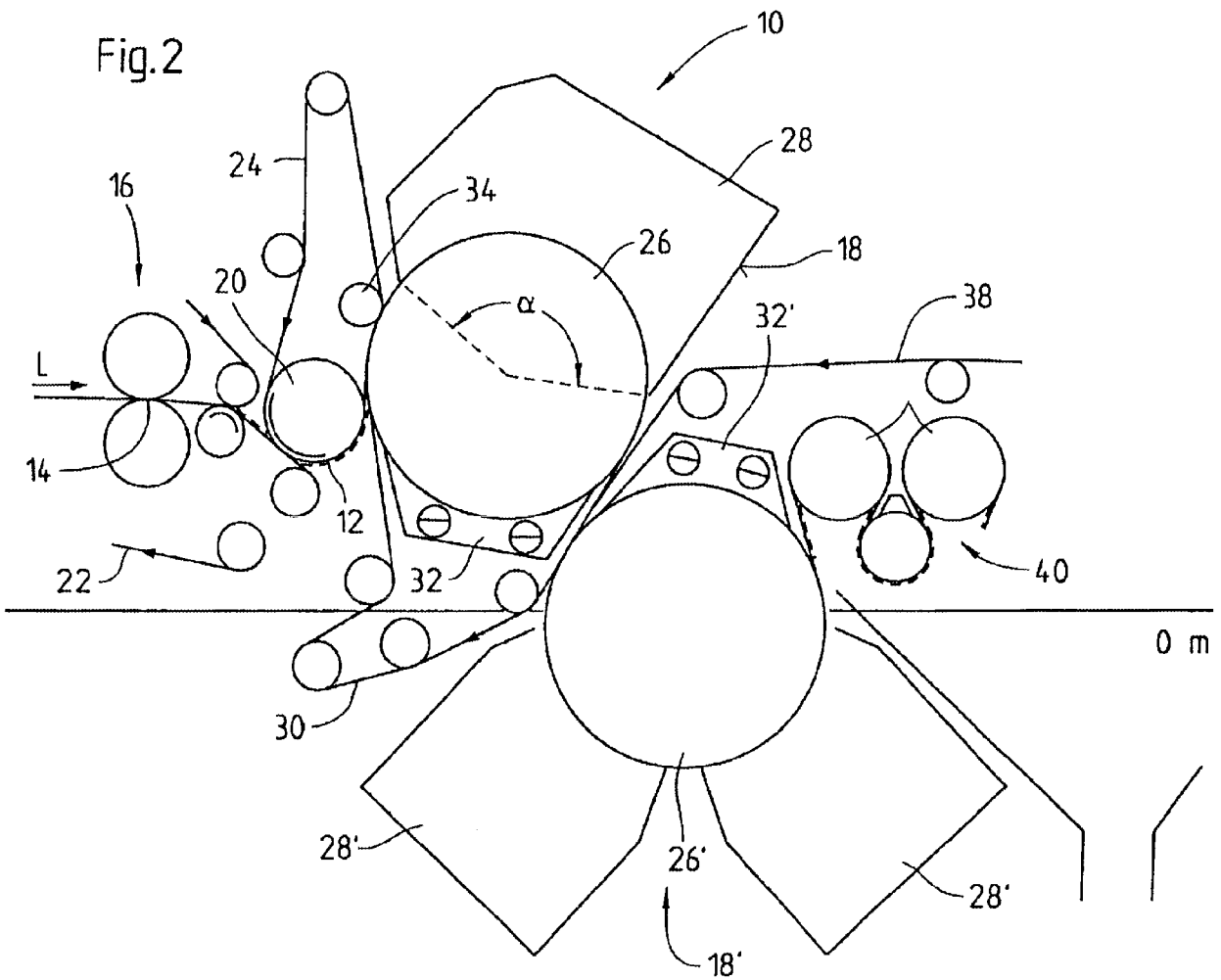
FIG. 2 schematically illustrates a further embodiment of the drying section with two impingement drying units.

As illustrated in FIG. 1, impingement hood 28 in impingement drying unit 18 subsequent to last pressing nip 14 is positioned and/or a wrapping angle $\alpha$ covered by impingement hood 28 is selected in such a way that a minimal distance between associated larger support roll 26 and last pressing nip 14 is made possible (see also FIG. 2). Further, impingement drying unit 18 can include a connected or integrated IR unit 54. Such an IR (infrared) unit particularly serves to heat the material web.

Figure 1B:
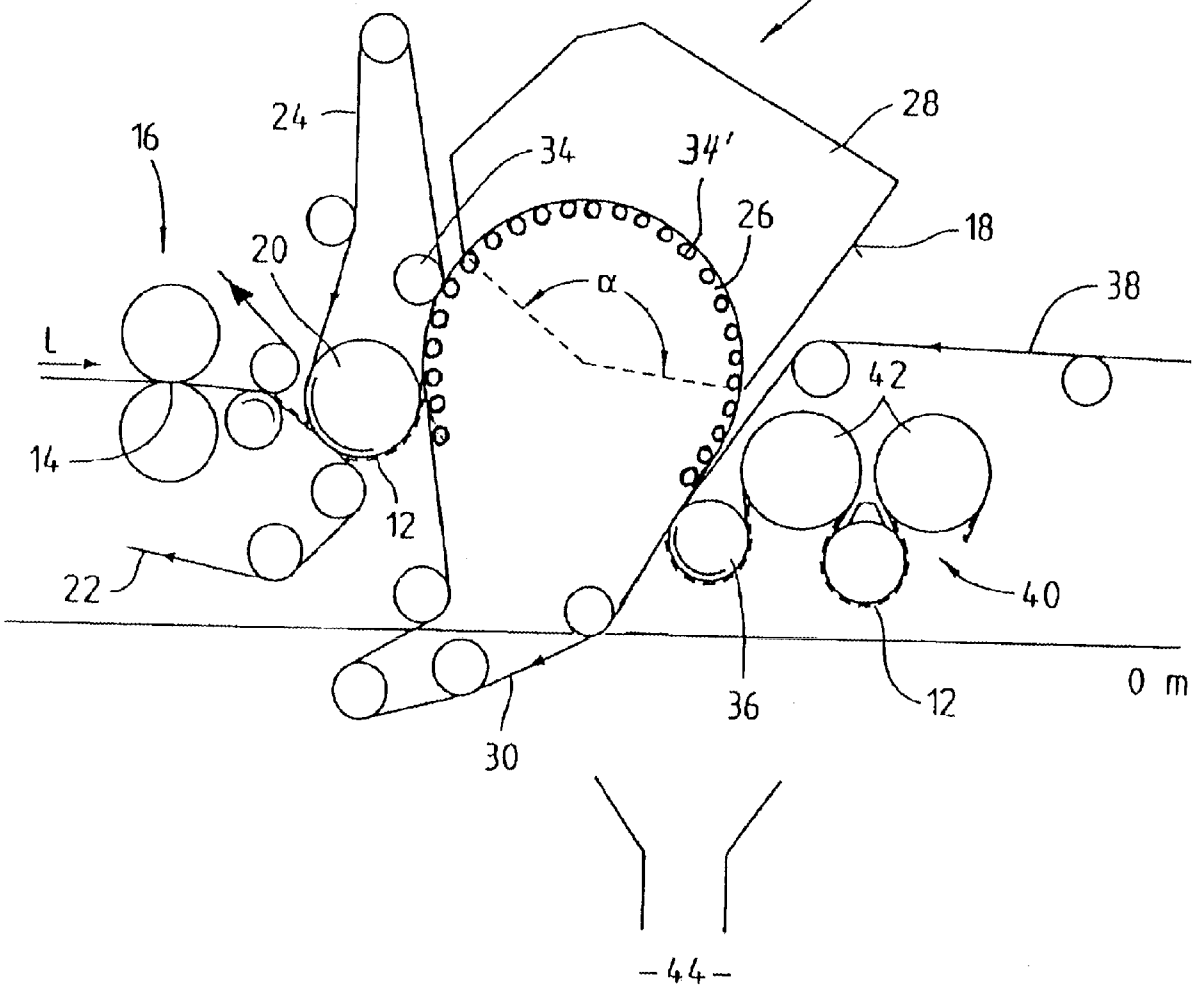
FIG. 1B illustrates an embodiment in which the impingement dryer utilizes a support belt in place of the support roll.

The acceptance of material web 12 by large support roll 26 is supported by a deflection roll 34 provided behind pick-up suction roll 20 in web travel direction L inside the loop of wire 24. After this acceptance, deflection roll 34 is arranged to rest against support roll 36, wire 24, and, therefore, material web 12, as well as being placed against support roll 26 in a region between pick-up suction roll 20 and deflection roll 34. However, instead of support roll 26, a support belt 26' can be guided over several support rolls 34' (see FIG. 1B). In this arrangement, it is useful for support rolls 34' to be at least partially arranged on the arc of a circle.

Subsequently to support roll 26, material web 12 is accepted in a region of a suction roll 36 by a wire 38 of a first multi-cylinder group 40 composed of several drying cylinders 42. Here, the transfer occurs in such a way that the paper can fall between wires 30 and 38 into a cellar 44 in the case of a tear.

The embodiment according to FIG. 2 is different from the embodiment described previously essentially in that, subsequent to impingement drying unit 18, which is provided subsequent to last pressing nip 14, a further impingement drying unit 18' is provided.

This second impingement drying unit 18' also includes a larger support roll 26' and an impingement or jet impingement dryer assigned thereto formed in this case by a two-piece impingement hood 28'. In this case as well, the support roll 26' is again formed by a suction roll to which, e.g., an outer suction box 32' is assigned. In the present case, the diameters of the two support rolls 26 and 26' are more or less equally large. Second support roll 26' is wrapped by wire 38 of first multi-cylinder group 40.

As illustrated in FIG. 2, material web 12 is transferred from wire 30 of first impingement drying unit 18 immediately to large support roll 26' of subsequent second impingement drying unit 18', which is wrapped by wire 38.

Large support roll 26' is arranged diagonally below large support roll 26. While impingement hood 28 of first impingement drying unit 18 is provided generally above the associated support roll 26', impingement hood 28', e.g., a two-part impingement hood, of subsequent second impingement dryer unit 18' is arranged generally below associated large support roll 26'. As a result, different sides of the web are impinged by impingement hoods 28 and 28'.

Otherwise, the embodiment according to FIG. 2 has essentially the same structure as that of FIG. 1. Accordingly, parts that correspond to one another are given the same reference characters. Further, the invention can include a respective tear sensor 53, e.g., an optical sensor, before and/or after a respective impingement drying unit or between impingement drying units following one another. As partial tears must be detected as well, it is useful for the monitoring to occur not only over one edge, but rather across the width. Moreover, hood 18, 18' is provided with hole-type nozzles 55 and/or suction slots 56 that are preferably covered with diaphragms 57 to protect them from scraps, i.e., paper scraps. Hole-type nozzles 55 can have a diameter, e.g., in the range of approximately 6 to approximately 10 mm, and suction slots 57, which are covered by diaphragms 57, have an open nozzle surface, e.g., in the range of preferably approximately 1.5 to approximately 3.5%.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed:

1. A drying section of a machine for producing a material web located downstream, relative to a web travel direction, from a pressing section comprising:

an impingement drying unit;

a pick-up suction roll positioned between a last pressing nip of the pressing section and said impingement drying unit, said pick-up suction roll having an outer diameter of in the range of approximately 1.2 to approximately 2.5 m;

one of a pressing felt guided through the last pressing nip and a transfer belt arranged to guide the material web, wherein said pick-up suction roll is arranged to transfer the material web from the one of the pressing felt and the transfer belt to said impingement drying unit.

2. The drying section in accordance with claim 1, wherein said pick-up suction roll comprises a large suction roll.

3. The drying section in accordance with claim 2, wherein the material web comprises one of a paper and cardboard web.

4. The drying section in accordance with claim 1, further comprising a wire arranged to wrap said pick-up suction roll.

5. The drying section in accordance with claim 1, wherein said pick-up suction roll is coated with a screen stocking.

6. The drying section in accordance with claim 1, wherein said pick-up suction roll comprises an interior suction box.

7. The drying section in accordance with claim 1, wherein said pick-up suction roll comprises a jacket and an exterior suction box arranged to provide suction via said jacket.

8. The drying section in accordance with claim 1, wherein said pick-up suction roll comprises a multi-zone suction box.

9. The drying section in accordance with claim 1, wherein said impingement drying unit comprising a support roll and an impingement dryer, said support roll being arranged to receive the material web from said pick-up suction roll.

10. The drying section in accordance with claim 9, wherein said support roll is a larger support roll.

11. The drying section in accordance with claim 9, wherein said support roll has an outer diameter in the range of approximately 2.5 to approximately 8 m.

12. The drying section in accordance with claim 11, wherein the outer diameter of said support roll is in the range of approximately 3 to approximately 5 m.

13. The drying section in accordance with claim 9, further comprising a wire arranged to wrap said support roll.

14. The drying section in accordance with claim 9, wherein said support roll comprises a suction roll.

15. The drying section in accordance with claim 9, wherein said support roll comprises a cylinder.

16. The drying section m accordance with claim 1, wherein said at least one impingement drying unit comprises a support belt supported by several support rolls and an impingement dryer.

17. The drying section in accordance with claim 16, wherein said support rolls are at least partially arranged on an arc of a circle.

18. The drying section in accordance with claim 1, wherein said at least one impingement drying unit comprises at least two impingement dryer units, each including a support roll and an impingement dryer.

19. The drying section in accordance with claim 18, wherein each said support roll is a larger support roll.

20. The drying section in accordance with claim 18, wherein each said support roll has an outer diameter in the range of approximately 2.5 to approximately 8 m.

21. The drying section in accordance with claim 20, wherein the outer diameter of each said support roll is in the range of approximately 3 to approximately 5 m.

22. The drying section in accordance with claim 18, further comprising at least two wires respectively arranged to wrap each said support roll.

23. The drying section in accordance with claim 18, wherein at least one of said support rolls comprises a suction roll.

24. The drying section in accordance with claim 18, wherein at least one of said support rolls comprises a cylinder.

25. The drying section in accordance with claim 1, wherein said at least one impingement drying unit comprises at least two impingement drying units, in which each includes a support belt supported by several support rolls and an impingement dryer.

26. The drying section in accordance with claim 25, wherein said support rolls of each impingement drying unit are at least partially arranged on an arc of a respective circle.

27. The drying section in accordance with claim 1, wherein said at least one impingement drying unit comprises at least one impingement hood.

28. The drying section in accordance with claim 27, wherein said at least one impingement drying unit further comprises a support roll, and said at least one impingement dryer hood is arranged to minimize a distance between said support roll and the last pressing nip.

29. The drying section in accordance with claim 28, wherein said at least one impingement drying hood covers a wrapping angle ($\alpha$) of said support roll.

30. The drying section in accordance with claim 1, wherein said at least one impingement drying unit comprises at least two impingement drying units arranged to follow one another so that the material web is immediately transferred from a preceding impingement drying unit to a subsequent impingement drying unit.

31. The drying section in accordance with claim 30, wherein each of said at least two impingement drying units are wrapped by respective wires, such that the material web is transferred from the wire of said preceding impingement drying unit to the wire of said subsequent impingement drying unit.

32. The drying section in accordance with claim 1, wherein said at least one impingement drying unit comprises at least two impingement drying units arranged to follow one another in an alternating fashion, whereby different sides of the web are impinged by impingement streams.

33. The drying section in accordance with claim 32, wherein, in a first impingement drying unit, arranged relative to the web travel direction, an upper side of the material web is impinged and, in a subsequent impingement drying unit, a lower side of the material web is impinged.

34. The drying section in accordance with claim 32, wherein, in a first impingement drying unit, arranged relative to the web travel direction, a lower side of the material web is impinged and, in a subsequent impingement drying unit, the upper side of the material web is impinged.

35. The drying section in accordance with claim 1, wherein said drying section is arranged between the last pressing nip of the pressing section and a first multi-cylinder group, and said at least one impingement drying unit comprises a one-piece impingement hood.

36. The drying section in accordance with claim 35, further comprising at least one further impingement drying unit comprising a multi-part impingement hood.

37. The drying section in accordance with claim 36, wherein said multi-part impingement hood comprises a two-part impingement hood.

38. The drying section in accordance with claim 1, wherein said drying section is arranged between the last pressing nip of the pressing section and a first multi-cylinder group in order to increase a dry content of the material web to within range of approximately 55% to approximately 65%.

39. The drying section in accordance with claim 1, wherein said at least one impingement drying unit comprises a connected or integrated IR unit.

40. The drying section in accordance with claim 1, wherein said at least one impingement drying unit is operated at a machine speed within range of between approximately 70 to approximately 120 m/s.

41. The drying section in accordance with claim 40, wherein said machine speed range is between approximately 80 to approximately 100 m/s.

42. The drying section in accordance with claim 1, wherein said at least one impingement drying unit is operated within a temperature range of between approximately 250 to approximately 450° C.

43. The drying section in accordance with claim 42, wherein said temperature range is between approximately 250 to approximately 350° C.

44. The drying section in accordance with claim 1, wherein said at least one impingement drying unit comprises a hood having at least one of hole-type nozzles and suction slots.

45. A drying section of a machine for producing a material web located downstream, relative to a web travel direction, from a pressing section comprising:

an impingement drying unit;

a pick-up suction roll positioned between a last pressing nip of the pressing section and said impingement drying unit; and one of a pressing felt guided through the last pressing nip and a transfer belt arranged to guide the material web, wherein said pick-up suction roll is arranged to transfer the material web from the one of the pressing felt and the transfer belt to said impingement drying unit, wherein said at least one impingement drying unit comprises a hood having at least one of hole-type nozzles and suction slots, and wherein said suction slits are covered by diaphragms to protect them from scraps.

46. A drying section of a machine for producing a material web located downstream, relative to a web travel direction, from a pressing section comprising:

an impingement drying unit;

a pick-up suction roll positioned between a last pressing nip of the pressing section and said impingement drying unit; and one of a pressing felt guided through the last pressing nip and a transfer belt arranged to guide the material web, wherein said pick-up suction roll is arranged to transfer the material web from the one of the pressing felt and the transfer belt to said impingement drying unit, wherein said at least one impingement drying unit comprises a hood having at least one of hole-type nozzles and suction slots, and wherein said hole-type nozzles have a diameter within a range of between approximately 6 to approximately 10 mm.

47. A drying section of a machine for producing a material web located downstream, relative to a web travel direction, from a pressing section comprising:

an impingement drying unit;

a pick-up suction roll positioned between a last pressing nip of the pressing section and said impingement drying unit; and one of a pressing felt guided through the last pressing nip and a transfer belt arranged to guide the material web, wherein said pick-up suction roll is arranged to transfer the material web from the one of the pressing felt and the transfer belt to said impingement drying unit, wherein said at least one impingement drying unit comprises a hood having at least one of hole-type nozzles and suction slots, and wherein said suction slots are covered by diaphragms which are arranged to provide an open nozzle surface in a range of between approximately 1.5 to approximately 3.5%.

48. The drying section in accordance with claim 1, further comprising at least one tear sensor positioned at least one of before and after said at least one impingement drying unit.

49. The drying section in accordance with claim 1, wherein said at least one impingement drying unit comprises at least two impingement drying units successively arranged in the web travel direction, and said drying section further comprises at least one tear sensor positioned at least one of before, after, and between said two impingement drying units.

* * * * *